US005374389A

United States Patent [19]

Friedrich

[11] Patent Number: 5,374,389

[45] Date of Patent: Dec. 20, 1994

[54] PROCESS FOR PRODUCING A CONTAINER WITH AT LEAST ONE CHAMBER FORMED BY A TUBULAR BODY

[75] Inventor: Richard Friedrich, Engen, Germany

[73] Assignee: Adolf Würth GmbH & Co. KG, Künzelsau, Germany

[21] Appl. No.: 936,654

[22] Filed: Aug. 28, 1992

Related U.S. Application Data

[60] Division of Ser. No. 652,230, Feb. 6, 1991, Pat. No. 5,156,309, which is a continuation of Ser. No. 180,102, May 11, 1988, abandoned.

[30] Foreign Application Priority Data

Jul. 16, 1986 [CH] Switzerland ..... 2847-86-5

[51] Int. Cl.[5] ..... B29C 49/00

[52] U.S. Cl. ..... 264/503; 264/83; 264/512

[58] Field of Search ..... 264/83, 512, 513, 523, 264/526, 573, 503

[56] References Cited

U.S. PATENT DOCUMENTS

| | | | |
|---|---|---|---|
| 1,864,621 | 6/1932 | Sprunger | 264/83 |
| 2,313,703 | 3/1943 | Hanna | 264/83 |
| 2,816,690 | 12/1957 | Lari . | |
| 3,028,290 | 4/1962 | Roberts et al. | 264/506 |
| 3,046,601 | 7/1962 | Hubbert et al. | 264/526 |
| 3,083,871 | 4/1963 | Jepson . | |
| 3,672,543 | 6/1972 | Roper et al. . | |
| 3,698,595 | 10/1972 | Gortz et al. . | |
| 3,738,538 | 6/1973 | Roper et al. . | |
| 3,767,078 | 10/1973 | Gortz et al. . | |
| 3,791,557 | 2/1974 | Venus, Jr. . | |
| 3,862,284 | 1/1975 | Dixon et al. | 264/526 |
| 3,876,115 | 4/1975 | Venus, Jr. et al. . | |
| 3,907,169 | 9/1975 | Gortz et al. . | |
| 3,940,026 | 2/1976 | Kain . | |
| 3,992,221 | 11/1976 | Homsy et al. | 264/83 |
| 3,998,363 | 12/1976 | Beres et al. . | |
| 4,121,737 | 10/1978 | Kain . | |
| 4,153,182 | 5/1979 | Loeliger . | |
| 4,222,499 | 9/1980 | Lee et al. . | |
| 4,324,350 | 4/1982 | Thompson . | |
| 4,367,187 | 1/1983 | Fukushima et al. | 264/526 |
| 4,446,991 | 5/1984 | Thompson . | |
| 4,464,980 | 8/1984 | Yoshida | 264/506 |
| 4,524,943 | 6/1985 | Busch et al. . | |

FOREIGN PATENT DOCUMENTS

| | | | |
|---|---|---|---|
| 2231194 | 12/1974 | France . | |
| 13-23027 | 10/1938 | Japan | 264/523 |
| 14-8674 | 5/1939 | Japan | 264/526 |
| 58-199132 | 11/1983 | Japan | 264/83 |
| 1463336 | 2/1977 | United Kingdom . | |

*Primary Examiner*—Catherine Timm

*Attorney, Agent, or Firm*—Antonelli, Terry, Stout & Kraus

[57] ABSTRACT

In a double chamber container, the inner chamber is formed by a tubular body of an elastic rubbery material stretched in order to expel a pressurized substance against its own elasticity. To obtain a precise stretching ratio of the tubular body and to empty it as well as possible, the tubular body converges uniformly and its walls have a uniform thickness, even in their bottom part. To attach the tubular body to the container, a collar which acts also as a seal is formed on the thereon. A process for producing the tubular formation includes bringing an elastomeric material into the flowable condition and coating it over a mandrel, and applying a cooling medium detachable from the mandrel over the mandrel initially and/or applying a treatment medium detachable from the mandrel over the latter subsequently, for the controlled alteration of the surface on the mandrel side of the elastomeric material. At least the mandrel can be set into rotation during application of coating or treatment medium and/or of the elastomeric material, for enhancing the distribution of the medium or material by centrifugal force.

7 Claims, 10 Drawing Sheets

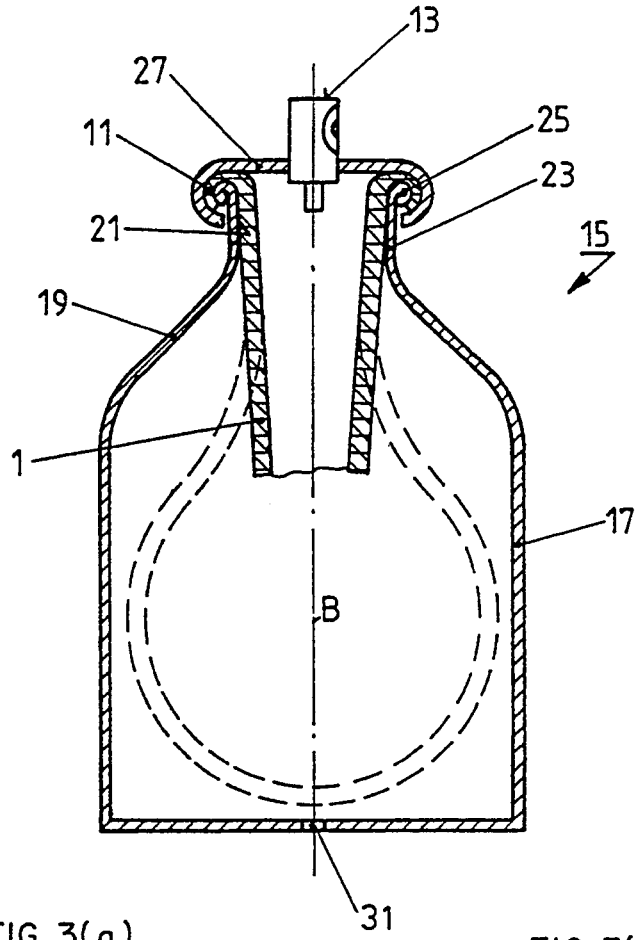
FIG. 2
FIG. 3(a)
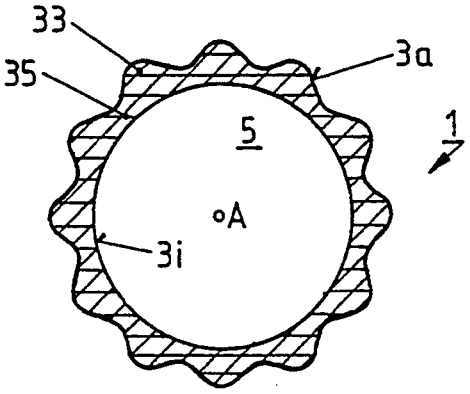
FIG. 3(d)
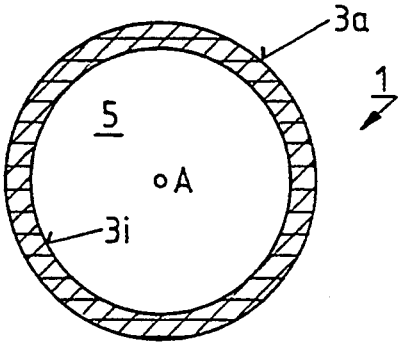
FIG. 3(b)
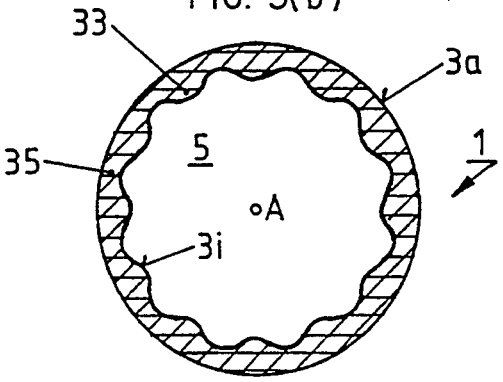
FIG. 3(c)
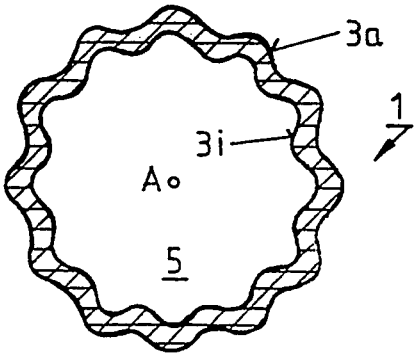

PROCESS FOR PRODUCING A CONTAINER WITH AT LEAST ONE CHAMBER FORMED BY A TUBULAR BODY

RELATED APPLICATIONS

This application is a division of application Ser. No. 07/652,230 filed Feb. 6, 1991, now U.S. Pat. No. 5,156,309 issued Oct. 20, 1992, which, in turn, is a continuation of application Ser. No. 07/180,102 filed May 11, 1988 and now abandoned.

TECHNICAL FIELD

The present invention relates to a container with at least one chamber defined in particular by a tubular formation of elastomeric material, which at a delivery opening communicates with at least one delivery valve for a filling substance held under pressure in the chamber due to the inherent elasticity of the formation and to a tubular formation of elastomeric material for defining a chamber, which can be connected at a delivery opening with a delivery valve for a filling substance held under pressure in the chamber due to the inherent elasticity of the formation.

Furthermore, the present invention relates to a method for the manufacture of such a formation and to an arrangement for performing this method, and to an arrangement for securing a chamber to a holder.

BACKGROUND ART

It has been known for a long time to define a chamber, within containers, such as cans, by means of an elastomeric formation, which latter communicates through a delivery opening with a delivery valve. The inherent elasticity of the elastomeric material of a synthetic or natural elastomer is utilized in order to put the filling material forced into the chamber under pressure so that it can be delivered by pressure from the valve.

Such cans or tubular formations of elastomeric material of the above-mentioned type are known in very different embodiments, as e.g. from:

U.S. Pat. Nos. 3,791,557, 4,121,737, 3,083,871, 4,222,499 British Patent 1,463,336 U.S. Pat. Nos. 3,738,538 3,672,543, 3,876,115, 2,816,690, 3,698,595, 3,940,026.

Although a multiplicity of proposals are known for providing cans with such a sock as a pressure-producing element, these techniques have in the past been seldom employed. This has been true although actually the advantage is obtained that no separate propulsion gas needs to be introduced, either in the filling substance itself or, in two-chamber cans, in a chamber between a can housing and the inner chamber receiving the filling substance. The problems which arise with cans or tubular formations of the initially-mentioned type are as follows:

When filling of the filling substance under pressure in order to expand the tubular formation provided, the expansion of the formation is scarcely controlled, so the elastomeric formation can expand more at certain parts than at others and consequently such parts are overstressed.

Upon emptying of the said formation, there remains an amount of filling substance which previously could be determined only with difficulty, which could not be predetermined, sometimes because of the above-mentioned difficult control of the formation expansion ratios during the filling of the substance under pressure.

DISCLOSURE OF INVENTION

In order to overcome these disadvantages and to provide a container or a formation of the initially-mentioned type, with which relationships which can be reproduced well are obtained during filling and emptying, it is now proposed according to the invention that the formation is formed convergent at least in a section which extends over a substantial portion of its axial extent and/or that the wall thickness of the formation varies in the axial direction.

Thereby it is ensured that the formation expands uniformly axially symmetrically in the said section during the filling of the filling substance under pressure, in addition to which it is also ensured that, upon emptying of the formation, an axial contraction to a well-defined residual internal volume of the formation occurs.

With a container with such a formation, which is formed with a cover portion with at least one opening and at least one valve holder part, it is furthermore proposed that the formation has, in the region of the delivery this collar is compressed between the parts as a sealing element.

A simple seal is thereby realized between the said formation and the actual can housing in that, with the formation in one piece, one or if required several, axially stacked circular disc seals are provided.

In the above-mentioned can or the above-mentioned tubular formation it is preferably proposed that the section extends over at least almost the entire axial extent of the formation.

The entire axial length of the formation is thereby utilized in order to obtain, with the conical shape, a controlled, axially-symmetrical expansion during the filling and a controlled contraction to an extensively known residual volume during emptying.

Preferably, the formation is so formed or provided in the container that the section is formed converging in the direction extending from the delivery opening. The wall thickness of the formation is in that case preferably formed so that it decreases in this direction. In addition to the above-mentioned advantage, this form also has the advantage that such a formation can be simply manufactured since the said direction of conicity ensures that the formation can, without anything further, be stripped from a manufacturing tool.

Although furthermore the formation can also be designed to be open at its end facing away from the delivery opening, namely in case a film bag is arranged within the formation, for example, in order to receive the filling material, yet it is preferably proposed that the formation is closed at its end facing away from the delivery opening and thus the formation proper constitutes the chamber and, inter alia, relatively complicated operations are avoided during manufacture, which operations necessitate that the aforesaid film bag must be inverted into the formation.

Moreover, although the pressure necessary for expanding the aforementioned formation can be affected by providing recessed portions of thinner wall thickness and, respectively, projecting portions of thicker wall thickness aligned along the outlines of the formation, whereby portions of differing wall thicknesses are created in cross sections of the formation, distributed around its periphery, the above-mentioned controllability during filling and emptying is achieved in the conical form provided according to this invention merely by the fact that at least almost the entire formation exhibits uniform wall thickness and/or a preferably constantly varying wall thickness.

Since the said wall thickness, together with the selected formation material, determine the expansion/-pressure properties of the formation and, therefore, must be formed relatively thick to ensure a sufficient delivery pressure until almost complete emptying of the formation, it is proposed that the wall thickness of the above-mentioned sealing collar be less in comparison to the wall thickness of the remaining formation.

Depending on the filling substance which is to be received in the said formation, the material of the formation must be selected so that, for example, with foodstuff to be inserted, no taste influence occurs, or for aggressive filling substances, no impairment, such as dissolution, of the material of the formation occurs.

This problem can of course be solved, depending upon the particular case, by utilizing an elastomeric material which fulfills the requirements.

The material costs for the said wall material, as also the manufacturing costs for such a formation can thereby be very variable, depending upon the material employed. In order to overcome this disadvantage, and to be able to cover at least the majority of the applications which arise with the same economical material, it is now further proposed that the formation be internally coated or internally treated in order to adapt the chamber wall independently of the elastomeric material to the characteristics of a filling substance. It is thereby possible to employ the same elastomeric material and, thus, also the same manufacturing processes for practically all applications and to firstly take into account the different filling substances by the internal coating or treatment of the said formation.

Furthermore reference is made herein to "coating" of the elastomeric material when an additional material is permanently applied to the elastomeric material. Reference is made to "treating" when the properties of the elastomeric material on the internal surfaces are altered to adapt them to their purpose. These two expressions can merge smoothly into one another since a treatment of the elastomeric material at its surface can lead to a build-up of a coating as well.

A method for the manufacture of a tubular or sock-shaped formation, such as the above formation, in such a way that different properties of filling materials can be taken into account, even with the utilization of a uniform elastomeric material, is characterized according to the invention in that elastomeric material is brought to a flowable state, applied over a mandrel and a coating medium, releasable therefrom, is applied previously or subsequently over the mandrel or a treatment medium is introduced previously or subsequently for the intended modification of the surface of the elastomeric material facing the mandrel.

In order, now, to ensure that with certain coating or treatment media an inner surface which tears away does not occur, even in the inflated state of the formation, it is proposed, in the manufacture of a sock-shaped formation, that the elastomeric material is brought to a flowable state, applied over a mandrel, and then the applied material is expanded by application of a pressure and a coating medium or treatment medium is applied.

By being subjected to a pressure, the material is expanded, as subsequently in use, released from the mandrel and the coating or treatment medium can be applied or introduced in the inflated condition, i.e. e.g. with the largest internal surface of the formation which occurs in use.

A simple possibility for inflating the formation of elastomeric material over the mandrel is obtained by applying the coating or treatment medium as a dust or mist driven by compressed gas, whereby the compressed gas effects the inflation of the formation, or applying the coating or treatment medium under superatmospheric pressure in the form of a liquid and withdrawing it under a subatmospheric pressure.

A further possibility comprises firstly applying a coating medium in a dipping process to the mandrel before applying the elastomeric material and then simultaneously treating, for example vulcanizing, the coating material and the elastomeric material.

By setting at least the mandrel in rotation, in the application of the coating or treatment medium and/or of the elastomeric material, the following is achieved:

If the mandrel is set in rotation together with the countermold during the application of the elastomeric material, then a uniform distribution of the elastomeric flowable material occurs, assisted by the resultant centrifugal forces.

If the mandrel is set in rotation after the application of the elastomeric material, with or without the countermold in the working position, then the centrifugal forces assist in driving the coating material downwardly along the conical mandrel.

If the elastomeric material is first inflated over the mandrel, and the coating or treatment medium then applied from the region of the mandrel, then the rotation of the mandrel produces a uniform distribution of the applied medium in the inflated inner chamber.

An arrangement for the manufacture of a tubular or sock-shaped body, e.g. for performing of the above method, has at least one mandrel with at least one passage for the wall material of the body, at least one delivery opening for a coating or treatment medium being provided in the region of the mandrel, preferably at least at the end.

For the utilization of the elastomeric material, it is proposed that the inlet for the liquified elastomeric material and, in the region of the mandrel, at least one pressure medium delivery opening terminates, which latter communicates with a pressure source independent of the coating medium or treatment medium supply, or with a pressure source for the transporting the coating or treatment medium.

In order to effect a uniform internal coating with the formation inflated or being inflated, it is now further proposed that the delivery opening for the coating or treatment medium includes a spray nozzle.

A simple embodiment possibility is provided when the delivery opening for the medium communicates with a pressure source in order to apply inflating pressure to the formation by the medium subjected to pressure and simultaneously to coat or treat the formation.

It is thereby achieved that a conveying medium, such as compressed air which transports the coating medium, for example in the form of a mist or dust, is used at the same time as the pressure medium for expanding the formation.

Instead of simply equalizing the superatmospheric pressure in the interior of the structure such as by opening a communication passage to the surroundings, after the structure has been expanded and coated, it is now furthermore proposed that in the region of the mandrel there is provided at least one return opening for medium which has not been applied, so that medium can first be applied under pressure, whereupon an expansion and coating or treatment of the formation takes place at the same time, and thereafter the medium can be drawn back and the structure again simultaneously collapsed over the mandrel.

Preferably, the delivery and return openings are formed together, as a single opening, and the pressure source is controllable for producing a superatmospheric pressure in a coating and treatment phase and if required in a drying phase, and subsequently a pressure which is reduced relative to the superatmospheric pressure in order to then draw back the unapplied medium and to collapse the formation over the mandrel.

In order at the same time to be able to work with the lowest possible pressure and to avoid loss of medium to the surroundings, sealing retainer elements for the formation are preferably provided in the base region of the mandrel.

Preferably, the arrangement furthermore has a rotary drive, at least for the mandrel. The mandrel thereby acts either as a centrifuge in order to feed the material applied onto it outwardly and, due to its conicity, upwardly or downwardly, or as a rotating spray head.

Furthermore it is proposed that delivery and return openings communicate with a tank for liquid coating or treatment medium, and that the mandrel is arranged hanging vertically downwardly, and that further at least one vent opening is provided, preferably, in the neck portion of the mandrel.

It is thereby possible to allow the liquid medium, assisted by pressure if required, to flow into the formation, whereby it is expanded and the outflow of air through the vent opening enables the entire inflated formation to remain stable in shape at a certain state of expansion and to be practically entirely filled with said liquid medium.

Occasionally it would be desirable if such a formation with the valve provided thereon could be flexibly secured to one holder or another, such as to one can or another. This is, for example the case when in the field of cosmetics various foam products have to be kept ready and, instead of individual cans a shelf is provided with various delivery valves, in such a way that the valves and formations must be secured to this shelf, on one hand, and on the other hand must be individually replaceable. Also, it may be desired to selectively provide containers with such formations with valves, which normally is not possible. To take these requirements into account, there is now proposed such a formation in which, in the region of the delivery opening, a releasable securing arrangement is provided for securing the formation to a holder, such as an opening of a container.

Preferably the formation has at least one annular collar in the region of the delivery opening, which is fixedly clamped between a valve holder part and an annular securing arrangement. The securing arrangement is extraordinarily simple in that it has a snap ring for securement at an opening, such as for securement to the neck of a bottle or can. Instead of a snap ring, a threaded fastener or a bayonet catch or the like can be provided.

An arrangement for securing a chamber, such as a chamber formed by the above-described formations with valve, to a holder such as to a can or bottle, is characterized in that it is releasable.

This arrangement for securing to a container with a neck of an opening is also preferably formed so that it has a snap ring for the neck fastener.

Referring back to the above-discussed container, there is often a need to have several such filling substances to hand. This can be the case, for example, for multi-component substances, such as adhesives, or also, for example, for cleaning materials for cleaning a surface of a material immediately before a further material is applied thereon. The faster the cleaning and application are done in succession, the greater is the guarantee that the surface is not again dirtied meanwhile, such as by dust particles. To take such needs into account, it is now further proposed to provide at least two formations co-axially or adjacent one another in one container. Thereby, without any difficulty, a chamber communicating with a valve can also be formed between the formations, or between one formation and a container wall, and thus can be made usable for one of the filling substances since, with rigid outer container wall and resilient intermediate walls, the pressure in the container is uniform throughout.

With the multiplicity of embodiments to be selected in one case or another, which are all considered to be inventive, the features of the formation considered at the present time to be essential may be reiterated as:

Conicity and/or axially varying wall thicknesses and/or selection of a thermoplastic elastomer as the wall material of the formation.

BRIEF DESCRIPTION OF DRAWINGS

The invention will be more readily understood from the following description of preferred embodiments thereof given by way of example with reference to the accompanying drawings, in which:

FIG. 2 shows schematically a longitudinal section of a can according to the invention with an elastomeric formation according to FIG. 1, FIG. 3 shows four different cross-sectional shapes of a formation according to the invention as shown in FIG. 1 or of a formation at a can according to the invention, such as according to FIG. 2.

BEST MODE FOR CARRYING OUT THE INVENTION

Figure 1:
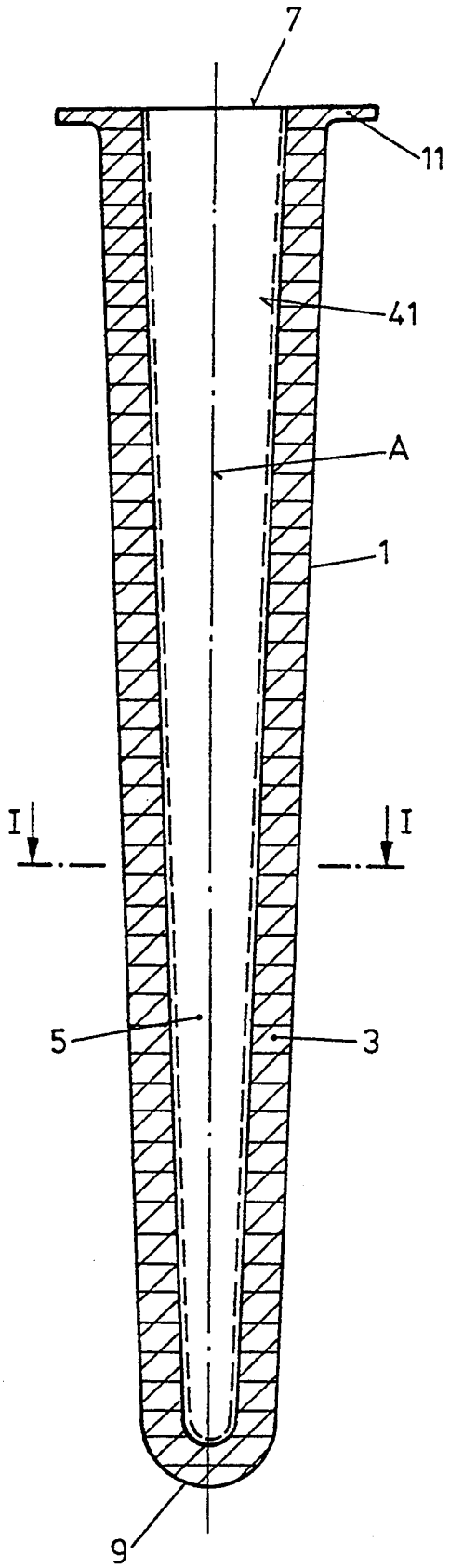
FIG. 1 shows a longitudinal section through a formation according to the invention.

According to FIG. 1, a sock 1 according to the invention of rubber elastic material comprises a body 3 which is rotationally symmetrical with respect to an axis A and which has in its interior a receiving chamber 5 for a filling. The sock 1 is both externally and internally conically formed and converges, starting from a receiving or delivery opening 7, towards its closed end 9. The wall thickness of the preferred embodiment of the sock shown in FIG. 1 is, apart from a radially, projecting collar 11 provided in the vicinity of the opening 7, uniform throughout, even in the region of its end 9, where the closure is formed as a semispherical cup. The projecting collar 11, in contrast, is formed thinner than the wall of the remaining sock.

Further embodiments according to the invention of the hose 1 according to the invention are illustrated in FIGS. 15–21. The following explanations with respect to FIGS. 2–14 apply analogously, for the hose embodiments illustrated in FIGS. 15–21.

As at preferred wall material for the socks according to the invention, an elastomer (thermoplastic rubber compound) is adopted.

Such a sock is mounted, as schematically illustrated in FIG. 2, in a can with a conventional outlet valve 13. The can 17 according to the invention comprises an outer housing 17, such as a housing of metal, with a closure part 19 which converges, for example uniformly, relative to a can axis 3 and which defines an opening 21 coaxial to the axis B. In the region of the opening 21 there is formed, at the region 19 of the can 15, a neck portion 23, the end of which is reinforced, for example by, a bead as illustrated at 25. In the finished condition, the collar 11 of the sock 1 is, as shown in FIG. 1, turned around the bead 25 at the neck portion 23 of the can and is subtended by a valve holder part 27. In this way, the collar 11 of the sock 1 is fixedly, clamped between the neck portion 23 of the can 15 and the valve holder part 27 and serves as a seal between the receiving chamber 5 of the sock 1 and the surroundings. Simultaneously, the collar 11 serves as a retainer for the sock 1 at the can 15.

To fill a material into the chamber of the sock 1, the filling material, such as a cosmetic foam, is forced into the sock 1, preferably directly through the check valve 13, whereby the sock, as shown in broken lines in FIG. 2, is expanded against its inherent elasticity forces. A vent opening 31 is provided at any location in the can 15, for example and as schematically illustrated at the bottom, through which, upon expansion of the sock 1, the air can escape from the intermediate chamber between the housing 17 and the rubber-resilient sock 1. Thanks to the shape shown in FIG. 1, according to which the sock is conically shaped along a substantial section of its axial extent, with a constant wall thickness, there is produced a controlled, rotationally symmetrical expansion of the sock and, upon the discharge of the previously filled medium, there finally remains only a volume of filling material corresponding to the residual volume illustrated in FIG. 1, corresponding to the chamber 5 in the relaxed condition of the sock.

In FIGS. 3*a* to 3*d*, four different possible cross-sectional configurations according to a section I—I of FIG. 1 are shown. According to FIG. 3*a*, the chamber 5 of the sock 1 is formed by a smooth surface $3_i$, while the other surface $3_a$ is wavy along the outer cross-sectional periphery, so that, in the direction of the outlines of the sock 1 according to FIG. 1, constant wall thicknesses conditions exist over the whole or parts of the length of the sock, which however vary in the said cross-sections.

In this way there are formed reinforced ribs 33 and reduced locations 35 along the outlines.

According to FIG. 3*b* the relationships are reversed in comparison with FIG. 3*a*. In this case the outer surface $3_a$ of the sock 1 is formed smoothly and, analogous to FIG. $3_a$, the inner surface $3_i$ is provided with thickened portions and thin portions 33 or 35 extending in the direction of the outlines.

In the embodiment shown in FIG. 3*c*, the wall 3 is curved with a constant wall thickness, so that both internally and also externally of the sock 1 there exists a wave-trough structure directed along the sock outlines.

Although with structures such as those illustrated in FIGS. 3*a* to 3*c* the resilient properties of the sock 1 can be deliberately affected, even with the embodiment shown in FIG. 3*d*, in which the internal and external surfaces $3_i$ and $3_a$ of the sock are smooth, the technique on which the present invention in based is achieved.

Figure 4:
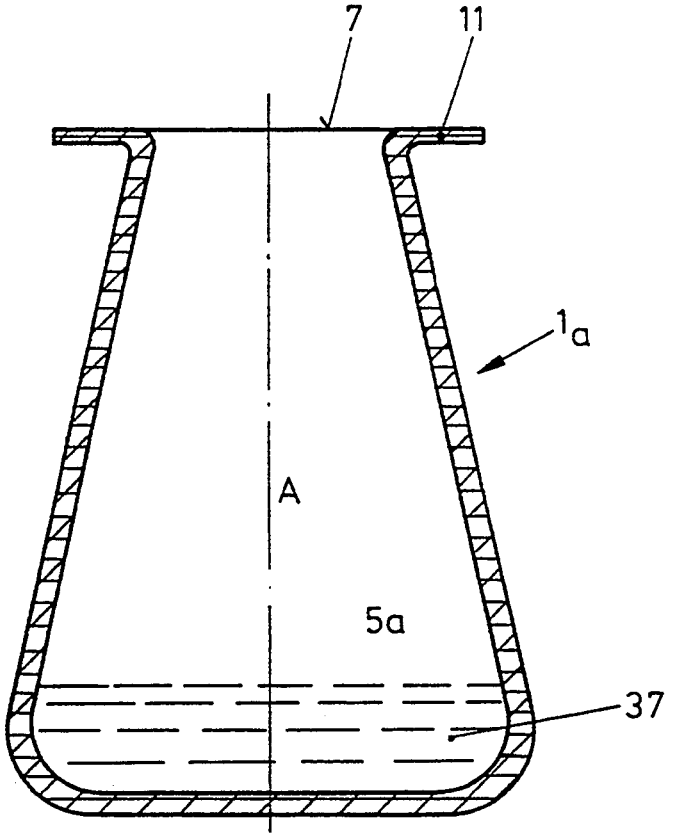
FIG. 4 shows schematically a further embodiment of a formation according to the invention.
Figure 5:
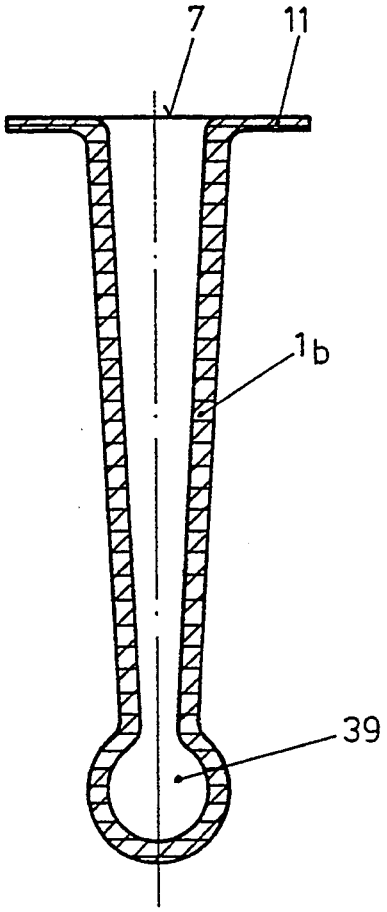
FIG. 5 shows schematically a further embodiment of a formation according to the invention.

In certain cases it is desired to avoid as much as possible delivering a component of the filling material. In such cases, an embodiment of the sock as shown in FIG. 4 or 5 is employed. At least a portion along the axial extent of the sock extending away from the delivery opening 7 is, in this case, divergent.

In FIG. 4, the entire axial extent is formed divergent along the axis A of a sock $1_a$, in distinction to the embodiment according to FIG. 1, so that in the released condition a downwardly enlarging chamber 5*a* is produced in the sock, whereby a filling material such as indicated by 37, also remains in the released condition of the sock $1_a$ and is not discharged.

In FIG. 5 there is formed in the sock 1*b* a chamber 39, as based on the shape shown in FIG. 1, the sock wall diverging in a section and then again converging, whereby a filling material again contained in the chamber 39, as in FIG. 4, is not discharged even when the sock $1_b$ assumes a released condition.

Also convergence as shown in FIG. 4 or 5, in which in distinction to the embodiment according to FIG. 1 the sock $1_b$, observed from the delivery opening 7, also diverges, ensures a controlled expansion and subsequent contraction of the sock, whereby in this case also one of the cross-sections illustrated in FIG. 3 can be adopted but the wall thickness is preferably constant on the main parts of the sock, i.e. apart from the collar 11, as per FIG. 3*d*.

Depending on the filling material for which the thus-far described sock should preferably be inserted into a can, as for example shown in FIG. 2, problems can arise because an elastomeric material to be adopted for economical and/or manufacturing reasons for the sock 1, $1_a$ or $1_{bh}$ as an undesirable reaction to the filling material, so that, for example when food is used as the filling material, a change of taste occurs or a filling material, in particular when stored for a long time in such a sock, affects the resiliency thereof so that, for example, edge regions of the chamber 5 are dissolved.

one possibility for overcoming such problems is of course to adopt an elastomeric material selected in accordance with the application. However, the material and manufacturing costs can thereby be greatly increased.

In order to avoid this disadvantage, and to be able to produce the sock with an economical elastomeric material which is easy, to process in manufacture, for certain applications the chamber 5 of the sock 1 or $1_a$ or $1_b$ is provided with an inner covering 41 or is internally treated. Thus, the inner covering 41 or the internal treatment, e.g. chemical, can be selected in accordance with the filling material and the same elastomeric material can be adopted for the sock 1, $1_a$ or $1_b$ for all cases.

Figure 6:
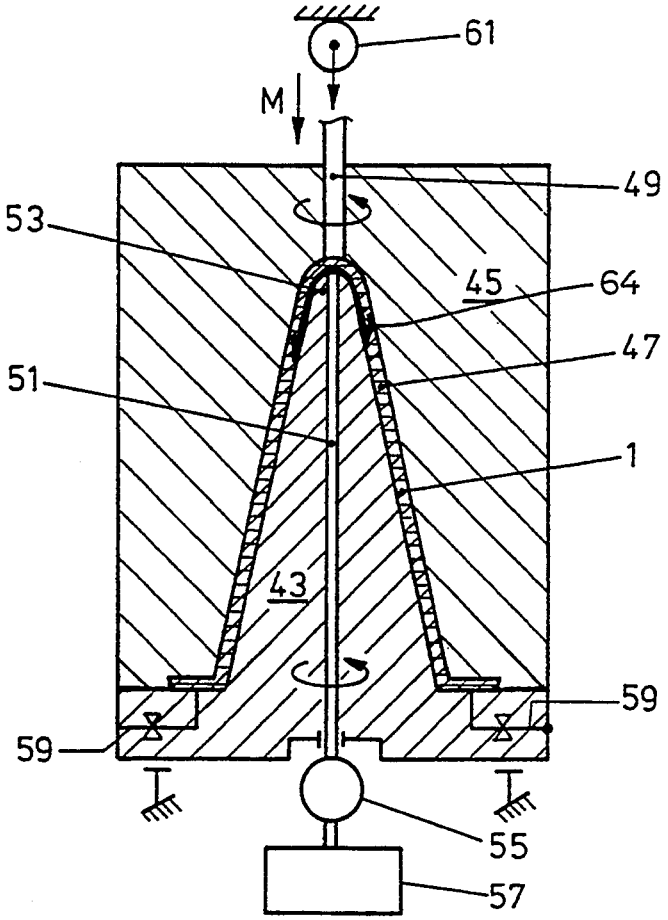
FIG. 6 shows a schematic illustration of an arrangement according to the invention operating according to a method according to the invention for the manufacture of an internally coated or internally treated formation according to FIG. 1.

In FIG. 6 there is schematically illustrated a first manufacturing arrangement according to the invention for such internally coated or treated socks, with respect to which a first embodiment of a manufacturing process relevant thereto will be described. As an inner mold there is provided a mandrel 43 which, together with an outer mold 45, forms a mold cavity 47 for a sock to be manufactured. Into the mold cavity 47 there opens a supply passage 49 for an elastomeric material, which is brought initially in a liquid condition and which, as indicated by the arrow M, is forced into the cavity 47.

When the cavity 47 has been filled with elastomeric material, a coating medium is forced in between the mandrel 43 and already introduced elastomeric material through a further supply passage 51, which preferably opens at the tip region 53 of the mandrel 43 and thus extends axially through the mandrel, such as by means of a compression assembly 55 from a coating medium tank 57.

The point of time at which this occurs, after the filling of the cavity 47 with elastomeric material which has been liquefied, depends upon the elastomeric material selected and on the desired coating medium, whether or not, for example, before assuming its final elastomeric characteristics, a chemical reaction between the coating medium and the elastomeric wall material is sought.

In order to facilitate downward flow of coating medium supplied through the passage 51, vent openings 59 extending to the exterior are provided, preferably at the base of the sock 1 forced in the cavity 47, so that the coating medium which is forced in cannot produce a superatmospheric pressure between the sock 1 and the mandrel 43.

Furthermore, it can be indicated that the distribution of the coating medium forced in be accelerated by setting in rotation the mold 45 and the mandrel 43 with the sock 1 located therebetween, at a high speed of rotation, by means of a rotational drive 61, whereby the coating material forced in is assisted by centrifugal force and due to the conicity of the mandrel 43 is flung downwardly. This is shown in the example of FIG. 6.

It is self-apparent in that connection that in such an embodiment, rotary couplings are provided at the conduits 51 and 49.

Figure 7:
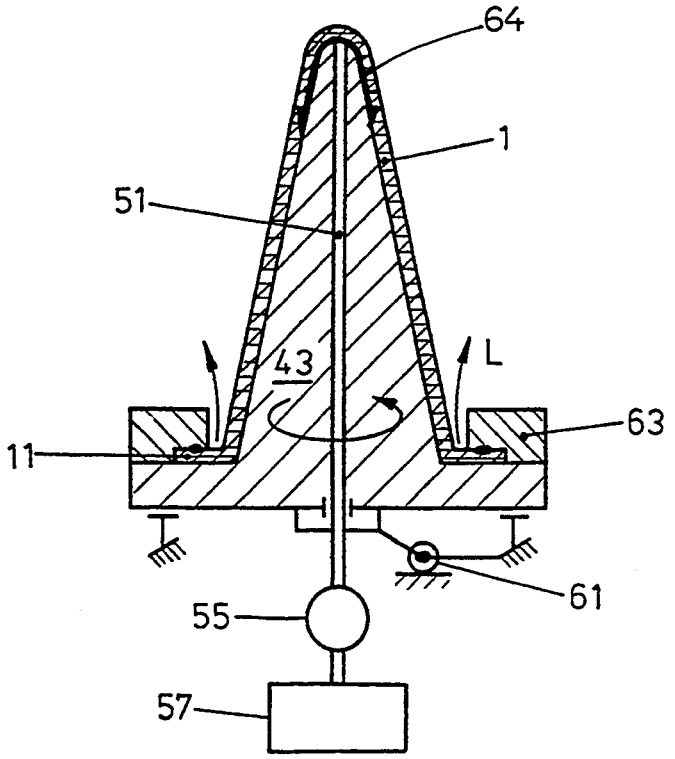
FIG. 7 shows, analogously to FIG. 6, a further embodiment of an arrangement according to the invention for performing a further variant of the method according to the invention.

In FIG. 7 there is illustrated an embodiment analogous to that of FIG. 6. In this case, after the application of the elastomeric material into the chamber 47 as shown in FIG. 6, the mold 45 is drawn back, so that it is no longer shown in FIG. 7. Coating material is now forced between the mandrel 43 and the sock 1 through the passage 51 by the compression assembly 55 from the tank 57, an annular retainer 63 fixedly holding the collar 11 of the sock 1 in the region of the base of the mandrel 43. Preferably, the retention of the ring 63 is so loose that, as indicated by the arrows L, air can escape between the mandrel 43 and the sock 1 as the coated medium is forced in. Also, in a modified embodiment a rotary drive 61 can be provided here in order to set the mandrel 43 into fast rotation and thereby to accelerate the distribution of the coating medium 65.

When the sock is manufactured by the method illustrated in FIGS. 6 and 7 or by the arrangements schematically illustrated therein, the coating medium is applied basically to a surface which corresponds to the released state of the sock.

With certain coating materials, it is now desirable that the coating should not be effected on the smallest possible surface, but with the largest surface coming into use, as will be explained with reference to the following figures.

Figure 8:
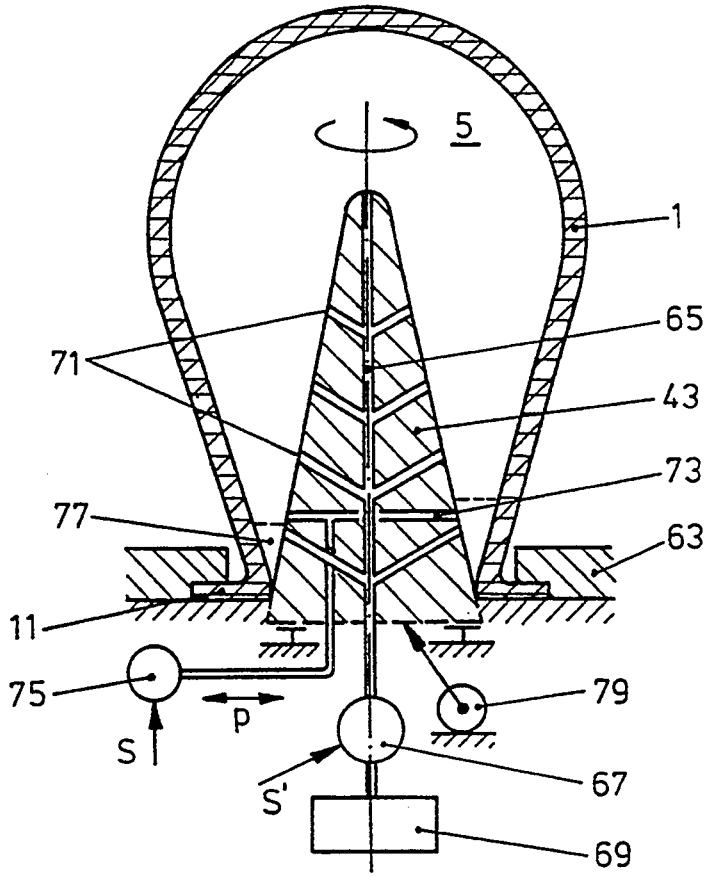
FIG. 8 shows a third embodiment in an illustration analogous to FIGS. 6 or 7, FIG. 9 a shows a fourth embodiment in an illustration analogous to FIGS. 6 to 8.

As shown in FIG. 8, a passage 65 extends through the mandrel 43 and communicates with at feed device 67 and a tank 69. The passage 65 branches so their outlet openings 71 are formed at more or less uniform spacings along the surface of the mandrel. Through the mandrel 43 there extends a further passage 73 with one or more orifices communicating with a pressure source 75. The pressure source 75 is controllable and provides, as shown by double arrow p, either a superatmospheric pressure or a pressure reduced relative thereto. In the tank 69 there is provided a coating or treating medium for the internal surface of the chamber 5 of the sock 1, while the pressure source 75 forces a compressed gas, such as air, through the passage 73 into the chamber 5. After the countermold 45 is removed in this case also after the filling of the elastomeric material as shown in FIG. 6, the pressure source 75 is activated and inflates the sock 1 so that it is released from the mold 43. The pressure is maintained so that the sock 1 remains stable in shape and then the coating or a treatment medium is applied from the tank 69 through the feed assembly 67 and the passage 65 to the internal wall of the inflated sock 1. The applied medium preferably constitutes a mist which is finely distributed by the feed assembly 67 by means of conveying air, preferably through nozzles provided at the ends of the passages 65, onto the inner wall of the chamber 5. In addition, there is preferably likewise provided at the base region of the mandrel 43 an opening of the conduit 65 so that by reversal S' of the feed assembly 67 any outflowing coating or treatment medium, as has been indicated at 77, can be drawn back again.

Furthermore, in order to achieve a uniform impingement on the inflated chamber 5, the tapered plug 43 can be set in rotation by means of a rotary drive 79, the retainer 63 and the inflated sock 1 remaining stationary.

The rotating mandrel 43 then acts as a rotating nozzle head.

The pressure produced by the feed assembly 67 through the nozzles provided in the chamber 5 can in this embodiment be kept low, since the inflation is ensured by the pressure source 75 through the passages 73. After the termination of the coating or treatment phase, and if required after a drying phase, by reversal of the pressure source 75 by the control S the internal pressure in the chamber 5 is reduced so that the sock 1 collapses onto the mandrel 43.

In contrast to the embodiment of FIG. 7, the ring retainer 63 in this case effects a tight retention of the collar 11, so that the pressure in the chamber 5 can build up.

Figure 9:
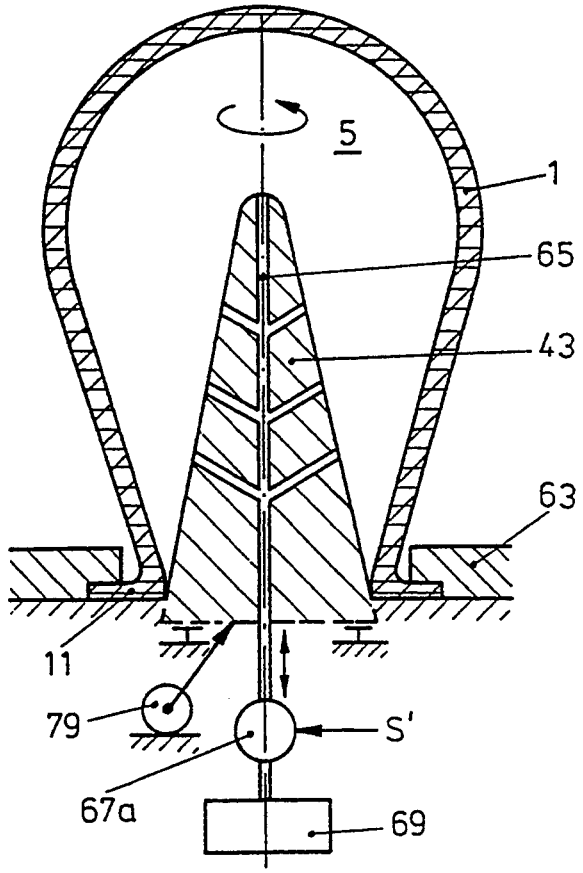

As shown in FIG. 9, which is based on FIG. 8, the independent pressure producing system 75, 73 is omitted and instead of it, coating or treatment medium is forced in by means of a pressure source 67*a* through the passage 65 under pressure into the chamber 5. Also in this case the medium is preferably applied into the chamber 5 by being propelled by means of a propulsion gas. To ensure a uniform application, a rotary drive 79 can be provided for the mandrel 43 acting as a spray head. The chamber 5 is tightly closed in the region of the collar 11 of the sock 1 by the ring 63.

Figure 10:
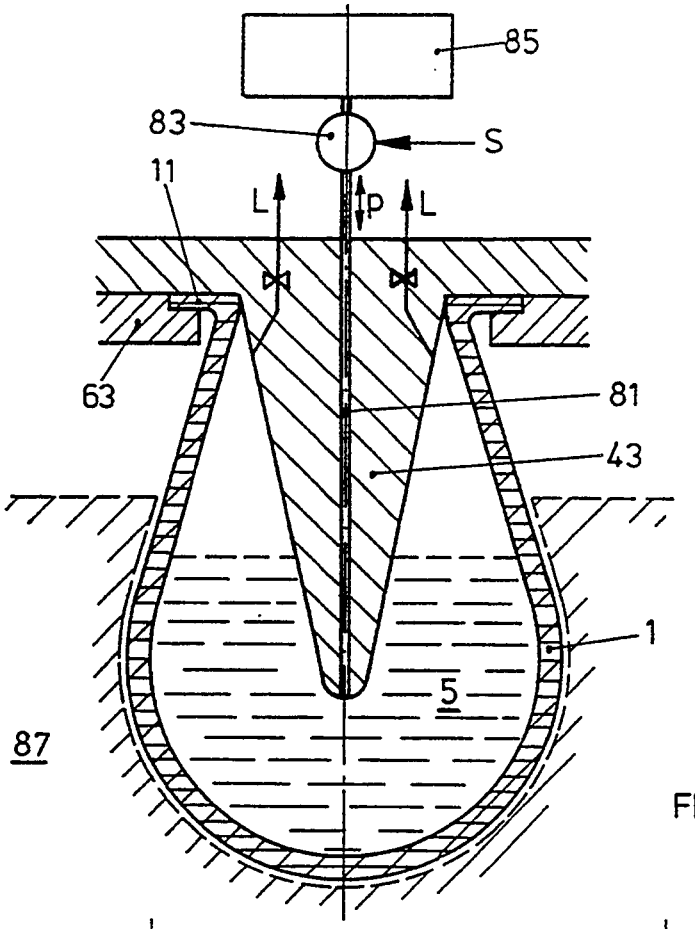
FIG. 10 shows fifth embodiment in an illustration analogous to FIGS. 6 to 9.

In FIG. 10 there is illustrated a further embodiment of the method or the arrangement for this application. The mandrel 43 in this case hangs downwardly and has a coating medium passage 81, communicating if required with a feed assembly 83 and a tank 85. After the sock has been produced over the mandrel 43, the countermold 45 as shown in FIG. 6 is also in this case drawn back downwardly, with the retaining ring 63 the collar 11 of the sock 1 held upwardly, and then coating or treatment medium in liquid form is filled into the chamber 5. The sock 1 is thereby inflated, initially relatively strongly, until because of the tensile/expansion properties of the wall the extension is less and the filling level rises. The air escapes upwardly through the vent openings L so that finally the coating or treatment medium fills the chamber 5. If required, and depending upon the properties of the sock wall, a countersupport 87 must be provided as shown in broken lines.

When the chamber 5 is full, then after a more or less long time, the feed assembly 83 is reversed and then sucks the coating or treatment medium out again, as indicated by the double arrow p, and the sock 1 collapses onto the mandrel 43.

Figure 11:
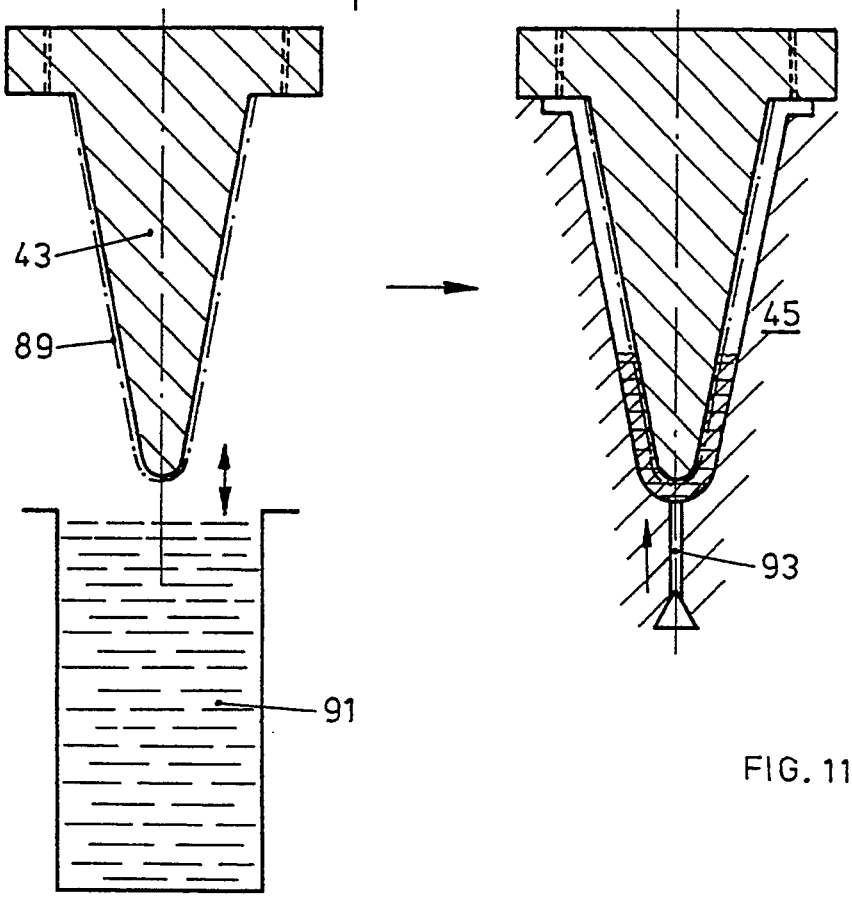
FIG. 11 shows a sixth embodiment in an illustration analogous to FIGS. 6 to 10.

In FIG. 11 there is illustrated a further embodiment of the internal coating of the sock. In this case the mandrel 43 is first provided with a coating 89 by, for example, being immersed in a dipping bath 91. Only after this is the countermold 45, as shown at the right in FIG. 11, brought into the working position and liquified elastomeric material is forced in through the passage 93.

Subsequently, the already preapplied internal coating 89 and the elastomeric material can be treated together, such as by being vulcanized.

With reference to FIG. 2 it was explained how a formation according to the invention is arranged in container according to the invention.

Figure 12:
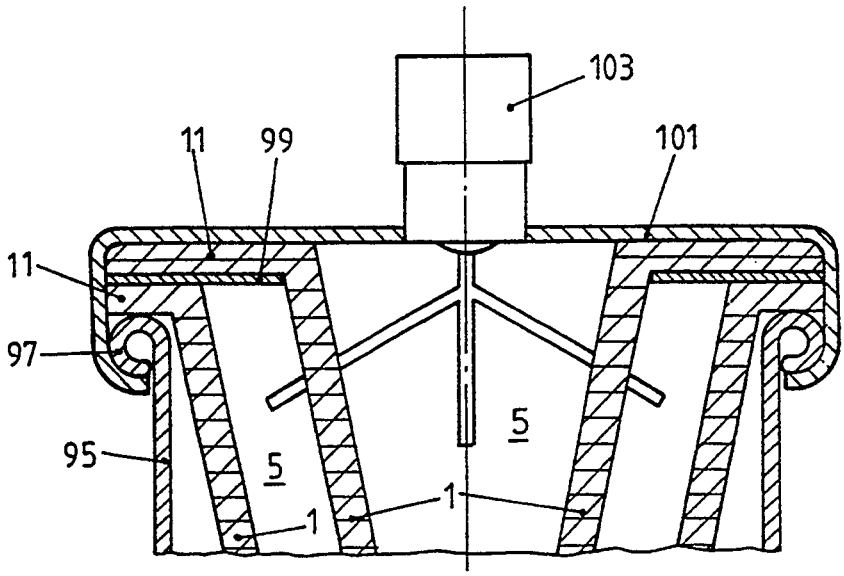
FIG. 12 shows a longitudinal section through the upper part of a container according to the invention with two co-axial formations according to the invention.

In FIG. 12 there is now shown a longitudinal section through an upper part of a container with a wall 95. Over the bead 97 of the wall 95 there is laid a first sock 1 as shown in FIG. 1, then an intermediate holder 99 and, coaxially thereon, a second sock 1 as shown in FIG. 1, the collar 11 of which is larger than that of the outer sock. k valve holder part 101 is placed over the collars of both socks and the intermediate part 99 and subtends the bead 97. In a container formed in this way, a first chamber 5 is formed within the inner sock 1 and a second chamber 5 is formed between the inner and outer socks, both with the same internal pressure. Either both chambers are then connected to respective pressure valves actuatable from the exterior, or as schematically illustrated in FIG. 12, a single valve 103 is provided which communicates with both chambers.

Figure 13:
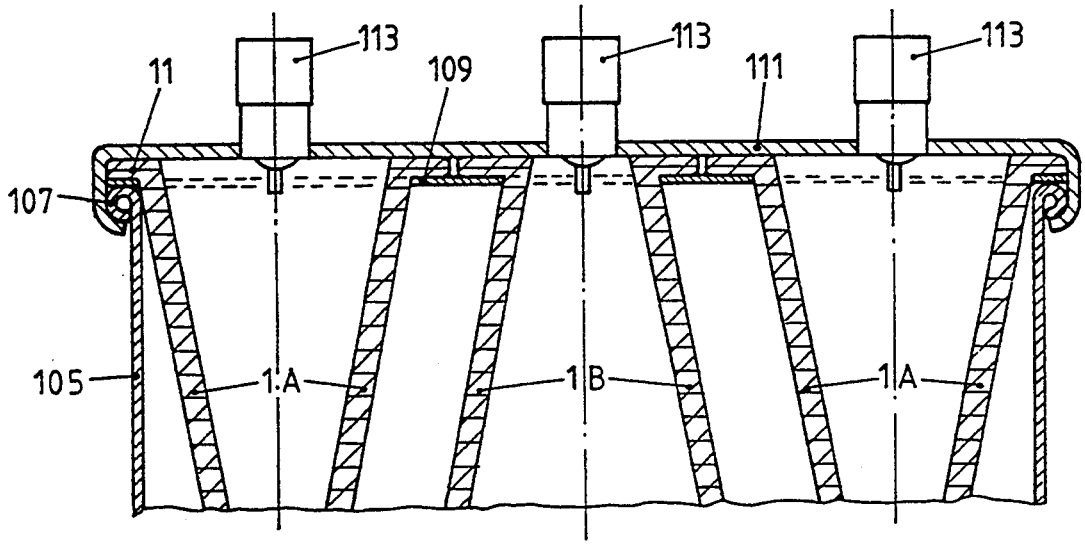
FIG. 13 shows an illustration analogous to FIG. 12 of a container according to the invention with formations according to FIGS. 1 and 4 stacked in one another.

A further multi-chamber can, analogous in manufacture to FIG. 12, is schematically illustrated in FIG. 13. In this case the fact that the shapes of the formations according to the invention as shown in FIGS. 1 and 4 can ideally, be stacked is utilized in such a way that the space available within a can interior can be optimally used. The outer wall 105 of the container again has a reinforcement or a bead 107, on which an intermediate holder 109 is supported. In respective openings a formation as shown in FIG. 1A as shown in FIG. 1 and then a formation 1B as shown in FIG. 4 are alternately inserted, and they are supported on their collars 11 on the intermediate support 109. A valve holder 111 again embraces the collars 11, the intermediate holder 109 and engages beneath the rim 107, whereby, as already mentioned in connection with FIGS. 2 and 12, the collars 11 serve as seals. In the regions of the socks 1A, 1B, respective valves 113 are provided.

Figure 14:
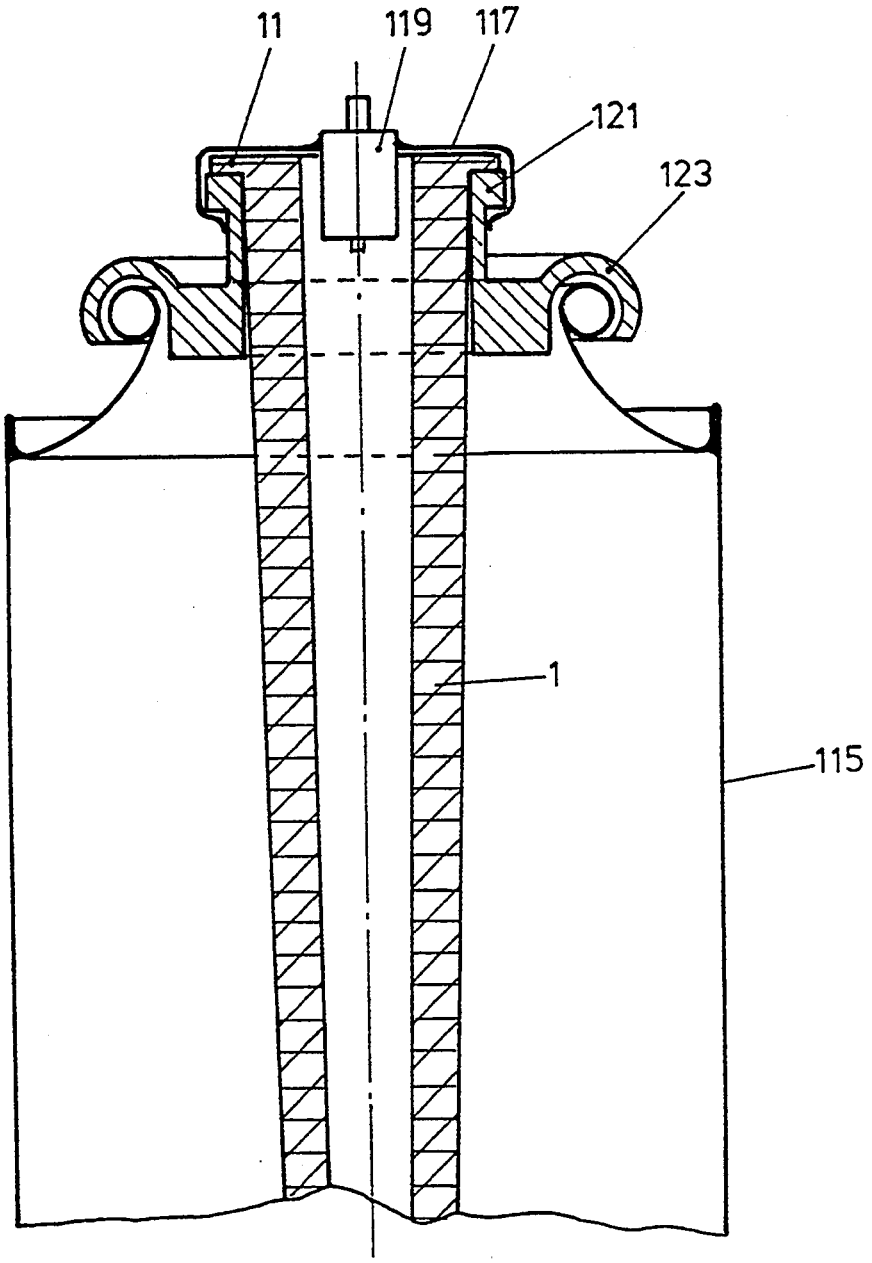
FIG. 14 shows a longitudinal section through a container according to the invention with formations according to the invention and arrangements according to the invention for removably securing the formation to the container as a holder.
Figure 15:
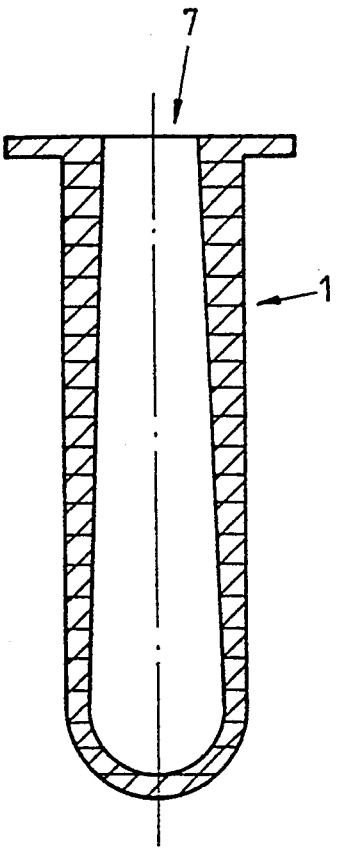
FIGS. 15–18 show further embodiment according to the invention of the elastomeric formation according to the invention in which the wall thicknesses of the formations, as viewed in the axial direction, vary.
Figure 16:
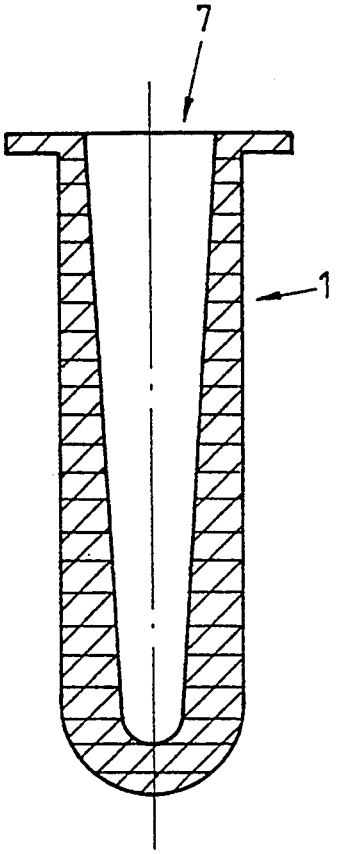
Figure 17:
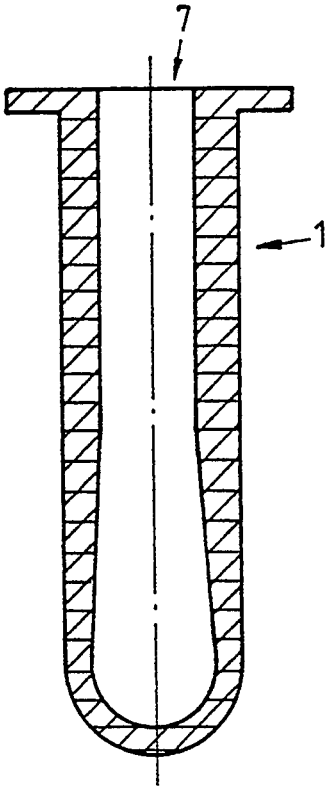
Figure 18:
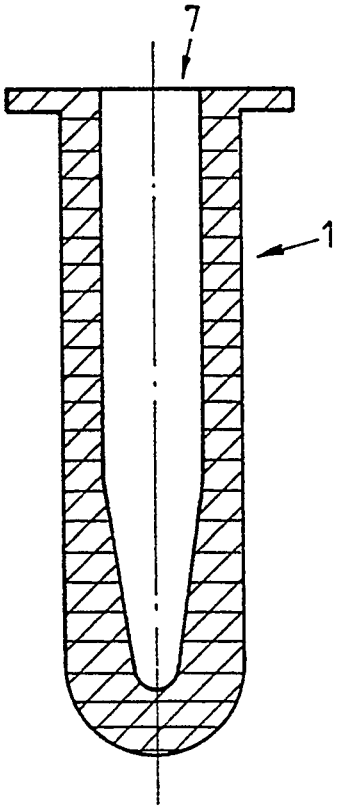

As shown in FIG. 14 a sock 1, as shown in FIG. 1, is arranged in analogy to the illustration of FIG. 2, in a can 115 serving as a holder. For this purpose, the collar 11 of the sock 1 is fixedly clamped between a valve holder part 117 with a conventional check valve 119 and a securing body 121. In this case also, the edge of the valve holder 117 grips beneath a shoulder on the body 121. In contrast to the illustration of FIG. 2, however, the body 121 is now formed as an adapter and has at its periphery a snap ring 123 with the help of which the entire unit of the sock, valve holder and adapter can be removably applied to the opening of a can 115 and, without any further measures, can be removed again without damage. Instead of such a snap ring the fixing arrangement according to the invention corresponding to 121 can have a threaded fastener or a bayonet fastener.

Referring back to the manufacturing process for the sock according to the invention illustrated in FIGS. 6 to 11, it must also be mentioned that the embodiments shown in FIGS. 8, 9 and 10 enable the sock to be tested in respect of its expansion mode before being utilized in a corresponding container. For this purpose, it is only necessary to monitor what shape the sock assumes when inflated over the mandrel 43 in order to be able to eliminate already in this manufacturing phase those socks which have non-uniform walls and correspondingly asymmetrical inflation.

While there was shown in FIG. 1 a sock 1 according to the invention which, as viewed in its axial direction, is conical, with a constant wall thickness, in FIGS. 15–18 there are shown socks according to the invention which externally are not conical and as viewed in the axial direction have a varying wall thickness. Thus, the wall thickness of the sock 1 in the embodiment example according to FIG. 15 decreases in the axial direction from the delivery opening 7 and increases in the embodiment example according to FIG. 16, and in fact does so in both embodiments along the entire length of the sock. In the embodiment example according to FIG.

17, the wall thickness of the sock 1 also decreases in the axial direction extending away from the delivery opening 7, but only along a section of the sock, namely in the case at the lowermost section. Analogously, the wall thickness increases in the embodiment example according to FIG. 18 in the direction extending from the delivery opening 7.

Figure 19:
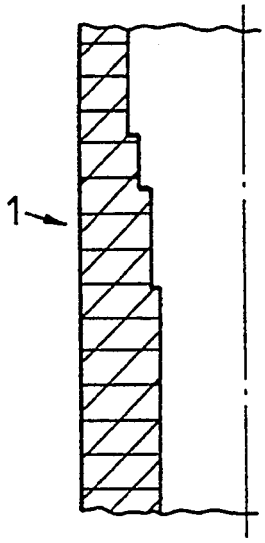
FIG. 19 shows a section of the wall of an elastomeric formation according to the invention in which the variation of the wall thickness occurs non-uniformly, i.e. in steps.
Figure 20:
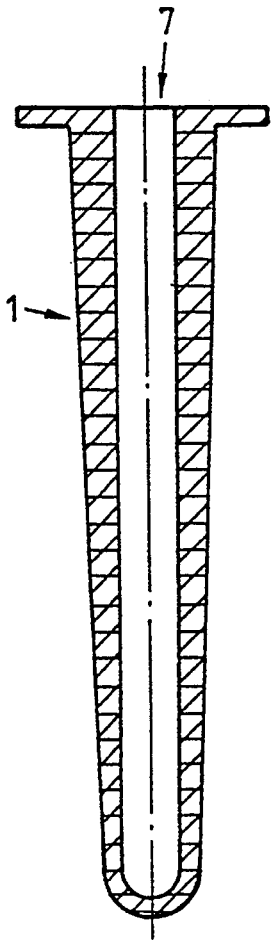
FIGS. 20 and 21 show two further, presently preferred embodiments of the elastomeric formation according to the invention.
Figure 21:
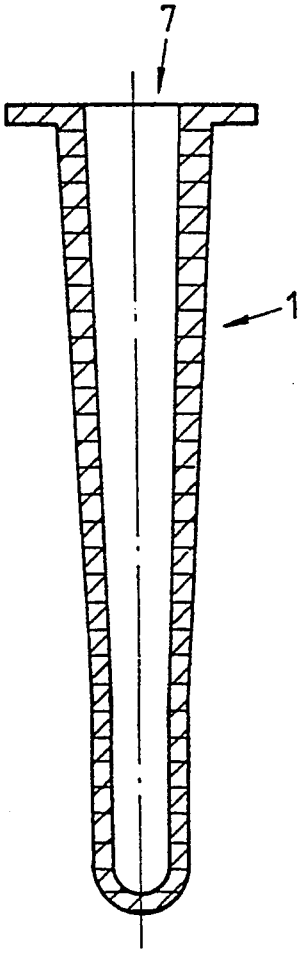

In FIG. 19 it is illustrated that the change in wall thickness need not be uniform in the axial direction of the sock 1 but can be definitely stepped. In the embodiments according to FIGS. 20 and 21 a preferred combination of the features of the embodiment example, according to FIG. 1 with constant wall thicknesses and the embodiment examples 15–18 with varying wall thickness are illustrated. According to FIG. 20 the sock 1 is on one hand conical, while on the other hand its wall thickness decreases in the direction away from the delivery opening 7 over the entire sock length, while in the embodiment of FIG. 21 the wall thickness decreases only in a section of the sock, namely an upper-section. In the lower section it is again constant. By a combination of the main features conicity of the sock in the axial direction and/or varying sock thickness in the actual collection, either uniformly or non-uniformly, whether over the entire length of the sock or cover only a predetermined section of the sock it is ensured that the expansion and contraction modes of the sock can be optimally controlled. By the selection of a thermoplastic elastomer as the wall material of the sock, alone or in combination with the previously mentioned constructional sock-features, there is likewise obtained a high controllability of the sock expansion and contraction.

In certain cases it can furthermore be advantageous to embed in the elastomeric sock a sealing plastic sheet material pouch which in practice comes directly into contact with the filling material of the sock instead of a coating and thereby prevents any taste contamination of the substance by the material of the elastomeric sock.

I claim:

1. Process for the production of a tubular or sock-like formation comprising bringing an elastomeric material into the flowable condition and coating it over a mandrel, applying a coating medium detachable from the mandrel over the mandrel initially and/or applying a treatment medium detachable from the mandrel over the latter subsequently, for the controlled alteration of the surface on the mandrel side of the elastomeric material, and wherein at least the mandrel is set into rotation during application of the coating or treatment medium and/or of the elastomeric material, for enhancing the distribution of the medium or material by centrifugal force.

2. Process according to claim 1, wherein the elastomeric material is brought to the flowable condition, is applied over the mandrel, whereafter the thus-applied material is expanded by application of pressure, and the coating medium or treatment medium is introduced.

3. Process according to claim 1, wherein the coating or treatment medium is introduced under pressurization and thus the material is expanded away from the mandrel.

4. Process according to claim 1, wherein the coating or treatment medium is introduced, under compressed gas action, as a dust or mist.

5. Process according to claim 1, wherein the coating or treatment medium is introduced under superatmospheric pressure in the liquid phase and is drawn back again under a pressure reduced with respect to the first-mentioned pressure.

6. Process according to claim 1, wherein the coating medium is initially applied onto the mandrel by dipping.

7. Process according to claim 1, wherein the coating or treatment medium is recovered after the coating or treatment operation.

* * * * *